US009313596B2

(12) United States Patent
D'Amore et al.

(10) Patent No.: US 9,313,596 B2
(45) Date of Patent: Apr. 12, 2016

(54) AUDIO SIGNAL DISTORTION DETECTION DEVICE

(75) Inventors: Anthony T. D'Amore, Phoenix, AZ (US); Juan Rodriguez, Phoenix, AZ (US); Steven Anthony Meade, Sacramento, CA (US)

(73) Assignees: D'Amore Engineering LLC, Camarillo, CA (US); Steve Meade Designs Inc., Sacramento, CA (US)

( * ) Notice: Subject to any disclaimer, the term of this patent is extended or adjusted under 35 U.S.C. 154(b) by 682 days.

(21) Appl. No.: 13/571,571

(22) Filed: Aug. 10, 2012

(65) Prior Publication Data

US 2013/0044886 A1 Feb. 21, 2013

Related U.S. Application Data

(60) Provisional application No. 61/525,193, filed on Aug. 19, 2011.

(51) Int. Cl.
*H04R 29/00* (2006.01)

(52) U.S. Cl.
CPC ..... *H04R 29/001* (2013.01); *H04R 29/008* (2013.01)

(58) Field of Classification Search
CPC ..... G01J 3/28; G01J 3/36; G10L 21/02; G10L 21/0205; G10L 21/0208; G10L 21/0232; H03F 1/26; H03F 1/32; H03F 1/3229; H03F 1/3241; H03F 1/3247; H03F 3/195; H03F 3/24; H03F 2200/294; H03F 2200/372; H03G 3/3052; H03G 3/32; H03G 9/025; H04B 1/0475; H04B 1/1036; H04B 10/07955; H04B 15/00; H04R 1/1083; H04R 2225/43; H04R 2430/03
USPC ..... 330/149, 151; 375/296, 350; 379/406.01; 381/56, 71.1, 94.1, 94.3, 381/98, 312, 317; 455/63.1, 67.11, 67.13, 455/114.2, 114.3, 296, 307; 700/94; 704/226
See application file for complete search history.

(56) References Cited

U.S. PATENT DOCUMENTS

| | | | | |
|---|---|---|---|---|
| 4,270,151 | A * | 5/1981 | Steinmaier | 360/31 |
| 5,483,617 | A * | 1/1996 | Patterson et al. | 704/207 |
| 2002/0094791 | A1 * | 7/2002 | Pehlke et al. | 455/115 |

* cited by examiner

*Primary Examiner* — Paul McCord
*Assistant Examiner* — Alexander Eljaiek
(74) *Attorney, Agent, or Firm* — Neustel Law Offices; Jason L. Gilbert

(57) ABSTRACT

An audio signal distortion detection device for simplifying the detection of harmonic distortion to aid in setting an amplifier's gain control to match an audio source unit's output voltage. The audio signal distortion detection device generally includes a housing having a plurality of status indicators thereon for indicating the status of an audio signal being fed into the housing's audio input. By utilizing a scaling circuit and processing unit, the present invention may be configured to detect four audio frequencies and compare DC levels of the frequencies to each other to determine if harmonic distortion is present. A distortion illuminator will illuminate when such distortion is detected and thus significantly reduce the effort required to setting an amplifier's gain control.

6 Claims, 3 Drawing Sheets

AUDIO SIGNAL DISTORTION DETECTION DEVICE

CROSS REFERENCE TO RELATED APPLICATIONS

I hereby claim benefit under Title 35, United States Code, Section 119(e) of U.S. provisional patent application Ser. No. 61/525,193 filed Aug. 19, 2011. The 61/525,193 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an audio signal device and more specifically it relates to an audio signal distortion detection device for simplifying the detection of harmonic distortion to aid in setting an amplifier's gain control to match an audio source unit's output voltage.

2. Description of the Related Art

Any discussion of the related art throughout the specification should in no way be considered as an admission that such related art is widely known or forms part of common general knowledge in the field.

The reduction of harmonic distortion is paramount to ensuring high quality audio through a speaker, amplifier and other sound-related devices. By reducing harmonic distortion, it can be assured that sound signals are being accurately reproduced with limited harmonics added by electronics or other outside sources.

In the past, the preferred method of adjusting an audio amplifier's input sensitivity control to reduce harmonic distortion was to use an oscilloscope. However, oscilloscopes often require a higher level of specialized training to ensure that the displayed waveform is properly interpreted by a technician. Thus, human error due to improper analysis of readings from an oscilloscope can result in a distorted reproduction of the audio signal. Other devices utilized for such functionality are generally not portable, expensive to purchase and difficult to read.

Because of the inherent problems with the related art, there is a need for a new and improved audio signal distortion detection device for simplifying the detection of harmonic distortion to aid in setting an amplifier's gain control to match an audio source unit's output voltage.

BRIEF SUMMARY OF THE INVENTION

The invention generally relates to an audio distortion detection device which includes a housing having a plurality of status indicators thereon for indicating the status of an audio signal being fed into the housing's audio input. By utilizing a scaling circuit and processing unit, the present invention may be configured to detect four audio frequencies and compare DC levels of the frequencies to each other to determine if harmonic distortion is present. A distortion illuminator will illuminate when such distortion is detected and thus significantly reduce the effort required to setting an amplifier's gain control.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview.

Figure 1:
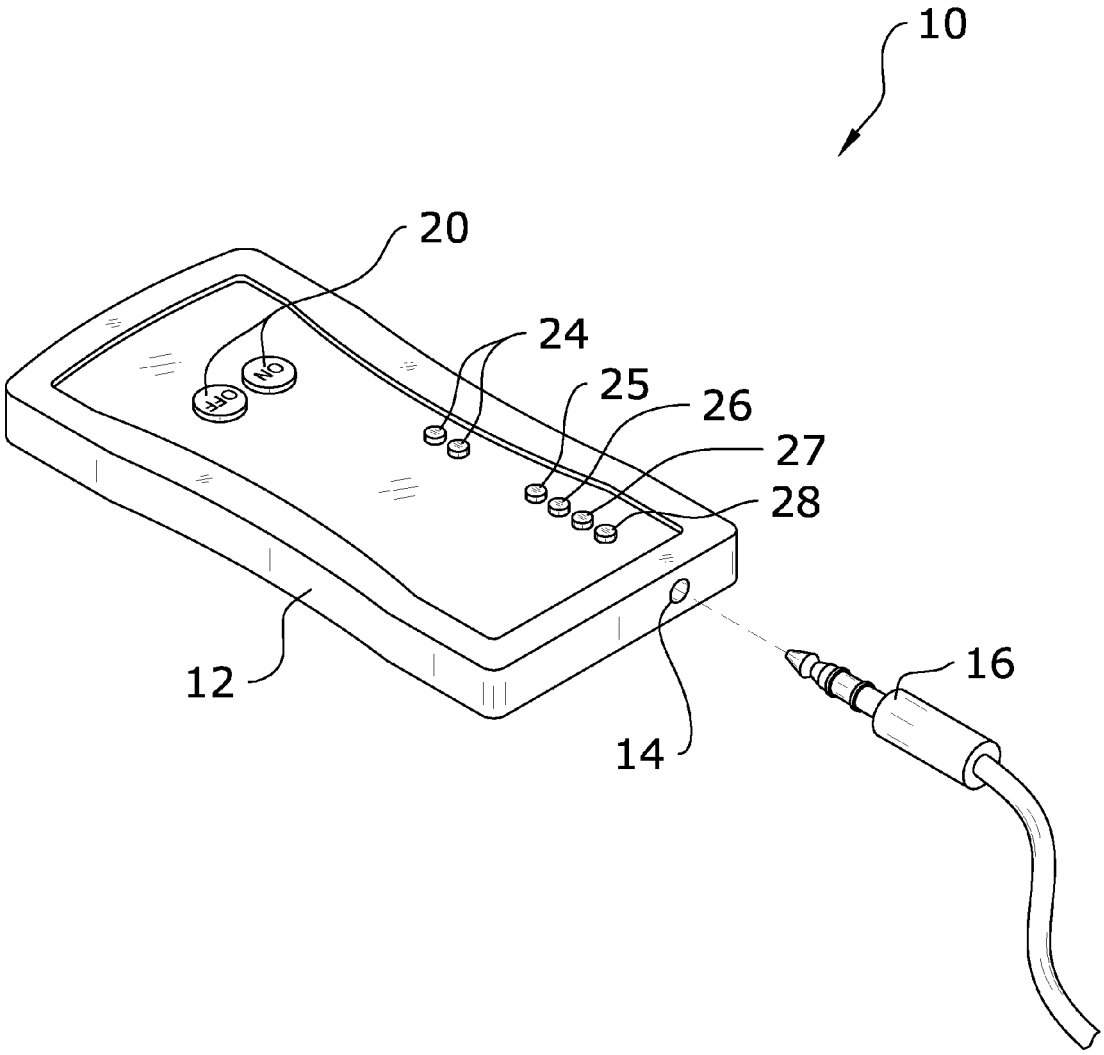
FIG. 1 is a frontal upper perspective view of the present invention.
Figure 2:
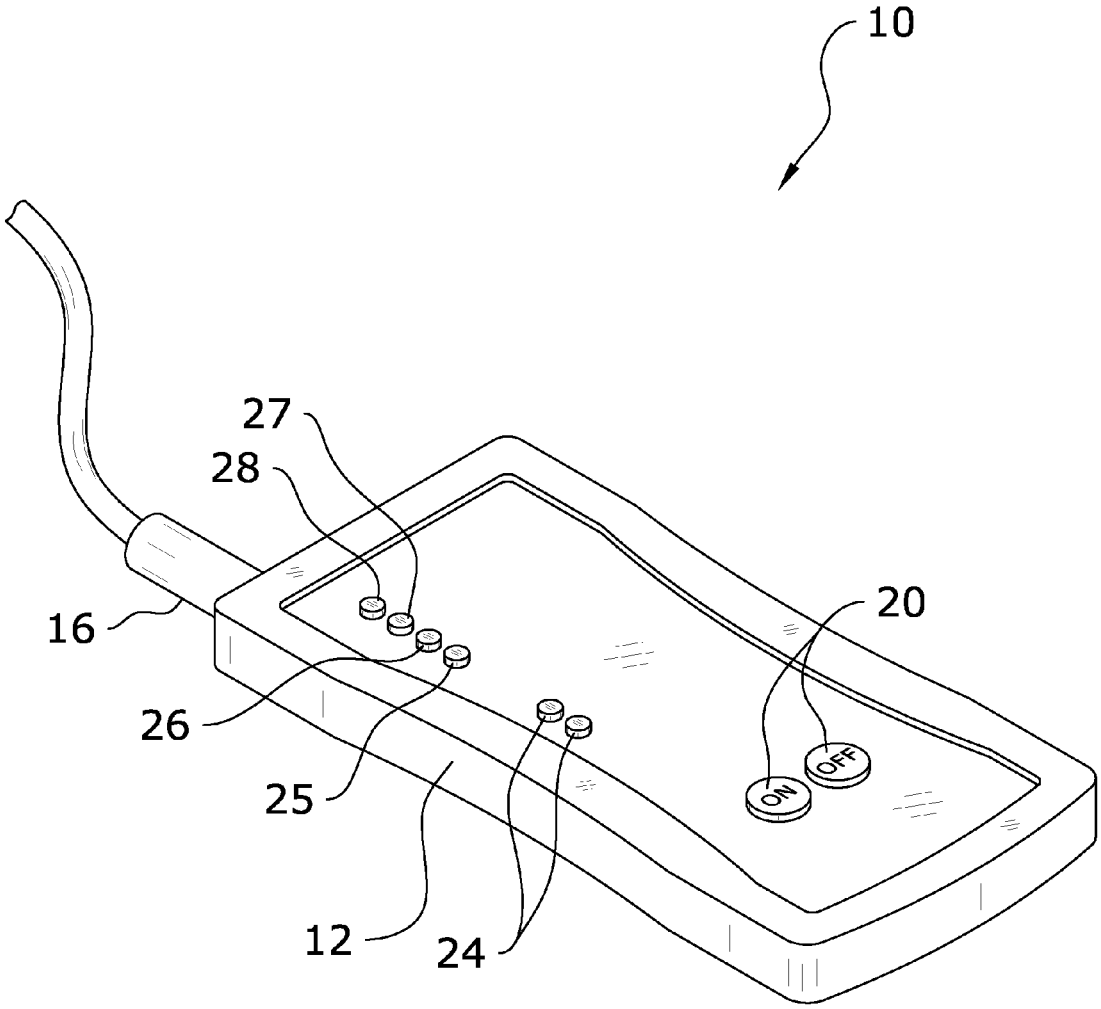
FIG. 2 is a rear upper perspective view of the present invention.
Figure 3:
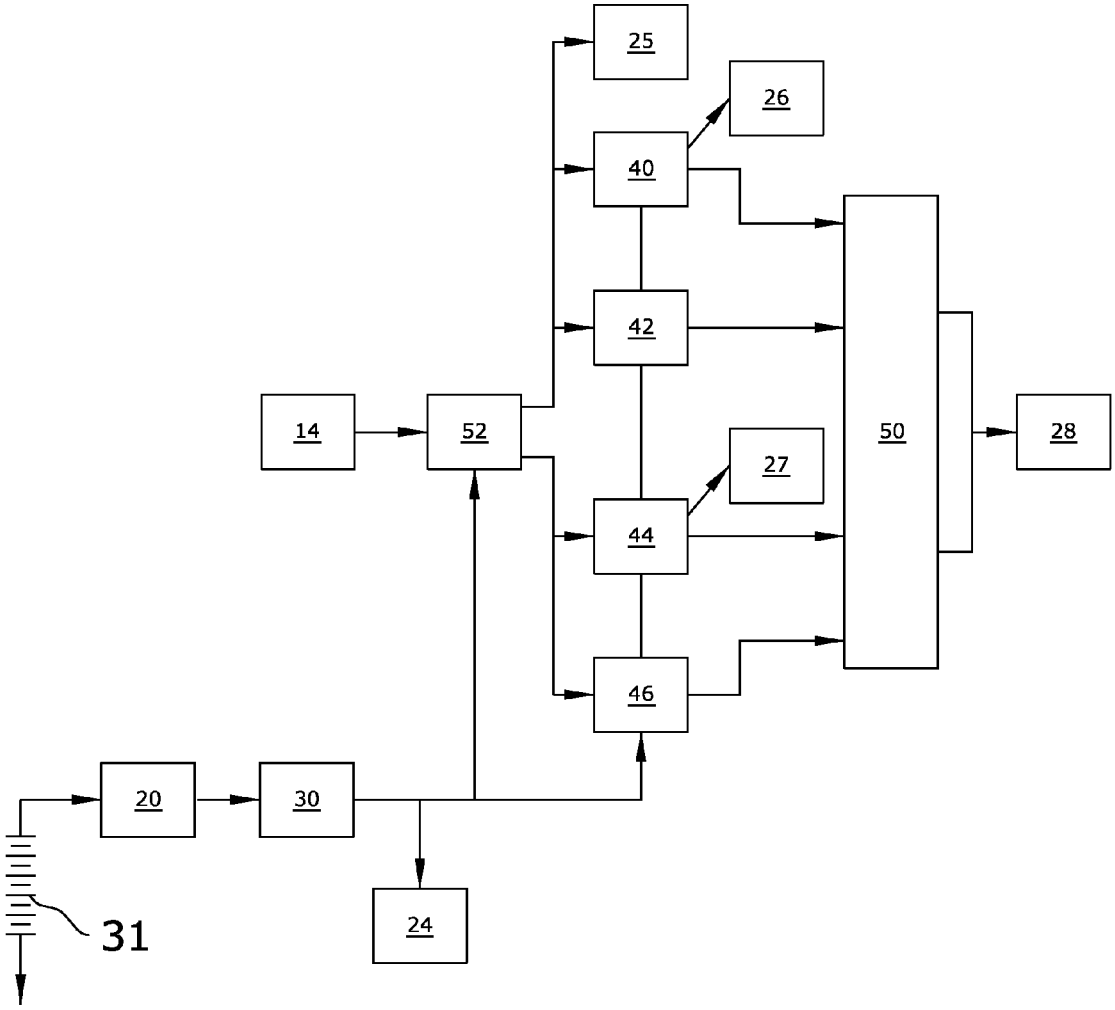
FIG. 3 is a block diagram illustrating one embodiment of the circuitry within the housing of the present invention.

Turning now descriptively to the drawings, in which similar reference characters denote similar elements throughout the several views, FIGS. 1 through 3 illustrate an audio signal distortion detection device 10, which comprises a housing 12 having a plurality of status indicators 24, 25, 26, 27, 28 thereon for indicating the status of an audio signal being fed into the housing's 12 audio input 14. By utilizing a scaling circuit 52 and processing unit 50, the present invention may be configured to detect four audio frequencies and compare DC levels of the frequencies to each other to determine if harmonic distortion is present. A distortion illuminator 28 will illuminate when such distortion is detected and thus significantly reduce the effort required to setting an amplifier's gain control.

B. Housing.

As shown in FIGS. 1 and 2, the present invention is generally comprised of a handheld, portable housing 12. It should be appreciated that the exemplary configuration and design of the housing 12 in the figures is meant for illustrative purposes. Thus, the scope of the present invention should not be construed as being limited to any particular design or configuration of the housing 12. By way of example and without limitation, the housing 12 could vary in size, shape, positioning of controls, positioning of indicators and the like.

The housing 12 of the present invention will include an audio input 14 through which an audio signal is received from an audio source 16. Various types of audio inputs 14 may be utilized, including RCA jacks and the like. Preferably, the audio input 14 will match the audio source 16 being tested, though it is appreciated that, in some systems, converters may be utilized to negate such a requirement.

The housing 12 will also generally include one or more power controls 20. The power controls 20 are utilized to turn the present invention on or off. While the figures show a pair of power controls 20, it is appreciated that a single control 20 could be utilized in some embodiments.

The housing 12 also includes one or more indicators 24, 25, 26, 27, 28 for providing a simple-to-read display for the various operations of the present invention. As shown in FIGS. 1 and 2, one embodiment of the present invention includes a power status indicator 24, a first audio signal indicator 25, a second audio signal indicator 26, a third audio signal indicator 27 and a distortion indicator 28. It should be appreciated that such an embodiment is merely exemplary and not intended to be limiting on the scope of the present invention. More or less indicators may be utilized and their arrangement on the housing 12 may vary for different embodiments of the present invention.

The power status indicator 24 is generally comprised of a light-emitting-diode (LED) or other similar visual indicator. The power status indicator 24 is utilized to provide information regarding the power supply of the present invention, such as whether the present invention is powered on or off. Further, the power status indicator 24 may in some embodiments indicate if the battery 31 is running low.

The present invention generally will include one or more audio signal indicators 25, 26, 27 comprised of LED's or other similar visual indicators. The exemplary figures show the use of a first audio signal indicator 25, a second audio signal indicator 26, and a third audio signal indicator 27. It is appreciated that the configuration, placement and number of audio signal indicators 25, 26, 27 may vary in different embodiments of the present invention.

In the embodiment shown in the figures, the first audio signal indicator 25 will illuminate or show some other visual indicator when input voltage detected at the audio input 14 exceeds 1 Vrms. The second audio signal indicator 26 will provide a visual indicator when a 40 Hz sine wave is detected at over 1 Vrms. The third audio signal indicator 27 will provide a visual indication when a 1 kHz sine wave is detected at over 1 Vrms. It is appreciated that these values are merely exemplary and thus should not be construed as limiting. The present invention may be configured with alternate values where a specific application calls for it.

The present invention also includes a distortion indicator 28 comprised of an LED or other similar visual indicator. The distortion indicator 28 provides a visual indication when the audio signal shows an amount of harmonic distortion. In alternate embodiments, other indications could be utilized to indicate harmonic distortion, such as an audible alarm through use of a speaker. The amount of harmonic distortion necessary to trigger the distortion indicator 28 may vary. By way of example, the distortion indicator 28 in some embodiments may show a visual indication when 120 Hz or 3 kHz is detected at a predetermined level compared to 40 Hz or 1 kHz.

C. Internal Components.

The configuration of the interior of the housing 12 (i.e. the selection of electronic components and their interconnection) may vary. Thus, the following description should not be construed as being limited, but merely an exemplary embodiment of one particular configuration which may be utilized in connection with the present invention.

FIG. 3 shows a block diagram illustrating such an exemplary embodiment of the components and interconnection of components of the present invention. As shown therein, the present invention generally includes a battery 31 which is connected to a power supply 30. Generally, a 9V battery 31 will input into the power supply 30, which will output +15V and −15V. In some embodiments, a linear regulator may be used for references for the processing unit 50. The output of the power supply 30 is also connected to the power status indicator 24. A switch may be utilized in between the battery 31 and power supply 30 which is tied to the power controls 20 for powering on/off the present invention. The power supply 30 will provide power to the various components of the present invention.

The audio signal is fed from the audio source 16 into the audio input 14 of the present invention. The audio signal is then fed into a scaling unit 52 which is comprised of an analog circuit which compares the voltage of the audio signal to two or more reference levels to select the scaling range of input (i.e. 3 ranges). The scaling circuit 52 may be implemented in a number of ways known in the art, and may include such components as comparators, relays and/or operational amplifiers. Thus, the appropriate scaling range for the signal to be fed into the filters 40, 42, 44, 46 is determined.

The scaled signal is preferably directed to one or more filters 40, 42, 44, 46 for use in aiding the processing unit 50 to detect distortion. The filters 40, 42, 44, 46 are preferably comprised of band pass filters which may be configured as known in the art to allow passage of certain frequencies. The filters 40, 42, 44, 46 are powered by the power supply 30.

A preferred embodiment of the present invention will include a first filter 40 comprised of a 40 Hz band pass filter, a second filter 42 comprised of a 120 Hz band pass filter, a third filter 44 comprised of a 1 kHz band pass filter and a fourth filter 46 comprised of a 3 kHz band pass filter. It is appreciated that these values are merely exemplary and may be altered for different applications.

After the audio signal is scaled and filtered, it will be fed into an AC/DC converter. The AC/DC conversion may be performed by various means known in the art, including an AC/DC rectifier circuit. The DC value of the audio signal is fed into the processing unit 50 of the present invention, the output of which determines the selective illumination of the audio signal indicators 25, 26, 27 and/or distortion indicator 28.

D. Operation of the Processing Unit.

The processing unit 50 of the present invention will be comprised of analog circuitry which is utilized to process signal information and determine whether harmonic distortion is present. The processing unit 50 may be comprised of various designs and interconnections of components, so long as it is capable of performing the necessary functionality for operation of the present invention, which is described below. Many implementations of the processing unit 50 may include analog comparators, operational amplifiers and the like.

By way of a first example, a 40 Hz sine wave with virtually no distortion is fed into the audio input 14. The first audio signal indicator 25 will illuminate to indicate detection of an audio signal. The signal is passed through the scaling unit 52 and then through a 40 Hz band pass filter 40. The output of the 40 Hz filter 40 is fed into an AC/DC converter, where it is converted to DC before being fed into the processing unit 50. If the processing unit 50 detects the filtered DC level of 40 Hz to be greater than 1 Vrms, the second audio signal indicator 26 will illuminate.

If the 40 Hz signal is distorted and generating $3^{rd}$ harmonic distortion (120 Hz), it will pass through the 120 Hz filter 42. This 120 Hz signal from the output of the 120 Hz filter 42 will be converted to DC and the DC level fed into the processing unit 50. The processing unit 50 will then compare the DC level from the first filter 40 with the second filter 42. If the level of DC from the second filter 42 is greater than the DC level from the first filter 40, the distortion indicator 28 will illuminate. Because the $3^{rd}$ harmonic distortion from a signal can never be greater than the signal itself, the filters 40, 42 have 40 dB of signal gain added within the filter stage. This 40 dB difference between the fundamental signal and the 3rd harmonic is indicative of a distortion ratio of 1.0% for those harmonic vs. the fundamental.

The same process may be utilized for a 1 kHz signal. If the processing unit 50 detects the filtered DC level of 1 kHz to be greater than 1 Vrms, the third audio signal indicator 27 will illuminate. If the signal is distorted and generating 3rd harmonic distortion (in this case, 3 kHz), this will pass through a 3 kHz filter 48. This 3 kHz signal will then be converted into DC and fed into the processing unit 50. The processing unit 50 will then compare the DC level from the 1 kHz filter 46 with the DC level from the 3 kHz filter 48. When the level of DC from the 3 kHz filter 48 is greater than the DC level from the 1 kHz filter 46, the distortion indicator 28 will illuminate due to this being indicative of a distortion ratio of 1.0% for that harmonic vs. the fundamental.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method of detecting harmonic distortion in an audio signal, comprising:

receiving an audio signal; then, illuminating a first signal indicator to indicate detection of said audio signal; then, scaling said audio signal with a scaling circuit to create a scaled audio signal; then, feeding said scaled audio signal through a first band pass filter to create a first filtered audio signal; then, feeding said first filtered audio signal through an AC/DC converter to create a first signal DC level; then, illuminating a second signal indicator to indicate detection of said first signal DC level; then, feeding said scaled audio signal through a second band pass filter to create a second filtered audio signal; then, feeding said second filtered audio signal through an AC/DC converter to create a second signal DC level; then, comparing said first signal DC level with said second signal DC level by a processing unit; and determining that harmonic distortion is detected in said audio signal if said second signal DC level is greater than said first signal DC level; then, illuminating a distortion indicator when harmonic distortion is detected in said audio signal;

wherein said first, second, and distortion indicators are each comprised of a light-emitting-diode.

2. The method of detecting harmonic distortion in an audio signal of claim 1, wherein said first band pass filter is comprised of a 40 Hz band pass filter.

3. The method of detecting harmonic distortion in an audio signal of claim 1, wherein said first band pass filter is comprised of a 120 Hz band pass filter.

4. The method of detecting harmonic distortion in an audio signal of claim 1, wherein said first band pass filter is comprised of a 1 kHz band pass filter.

5. The method of detecting harmonic distortion in an audio signal of claim 4, wherein said second band pass filter is comprised of a 3 kHz band pass filter.

6. The method of detecting harmonic distortion in an audio signal of claim 1, wherein said processing unit is comprised of an analog comparator.

* * * * *